US011950708B2

(12) United States Patent
Deng

(10) Patent No.: US 11,950,708 B2
(45) Date of Patent: Apr. 9, 2024

(54) ADJUSTABLE CHAIR HEADREST

(71) Applicant: Shenzhen Microtouch Ergonomic Technology Inc., Shenzhen (CN)

(72) Inventor: Jianbo Deng, Shenzhen (CN)

( * ) Notice: Subject to any disclaimer, the term of this patent is extended or adjusted under 35 U.S.C. 154(b) by 153 days.

(21) Appl. No.: 17/806,125

(22) Filed: Jun. 9, 2022

(65) Prior Publication Data

US 2023/0232989 A1 Jul. 27, 2023

(51) Int. Cl.
*A47C 1/10* (2006.01)
*A47C 3/00* (2006.01)
*A47C 7/38* (2006.01)

(52) U.S. Cl.
CPC ..... *A47C 7/38* (2013.01)

(58) Field of Classification Search
CPC ..... A47C 7/38; A61G 15/125; A61G 5/121; B60N 2/806
See application file for complete search history.

(56) References Cited

U.S. PATENT DOCUMENTS 3,497,259 A * 2/1970 Sherfey ..... A61G 5/1054 297/391
5,967,613 A * 10/1999 McKeever ..... A61G 5/12 297/406
9,521,908 B1 * 12/2016 Beck ..... A47C 7/38
11,510,494 B2 * 11/2022 DuFresne ..... B60N 2/806
2012/0104807 A1 * 5/2012 Lauchle ..... A47C 7/383 297/180.11
2013/0069411 A1 * 3/2013 Walker ..... A47C 7/38 297/391
2021/0007491 A1 * 1/2021 Budiman ..... A47C 7/38
2023/0232989 A1 * 7/2023 Deng ..... A47C 7/38 297/409

* cited by examiner

*Primary Examiner* — Shin H Kim
(74) *Attorney, Agent, or Firm* — Xia Li

(57) ABSTRACT

An adjustable chair headrest, relating to the technical field of office chairs, comprises a support rod connected to a chair back and a headrest, and further comprises an elastic sliding mechanism connecting the headrest and the support rod. The elastic sliding mechanism is provided with a lock mechanism and comprises a stop block, a sliding push rod and an elastic telescoping mechanism, and an end, away from the stop block, of the sliding push rod is connected to the headrest. One end of the sliding push rod stretches into a groove of the support rod, and a gap is reserved between the sliding push rod and one end of the stop block. A tension spring is disposed in the gap and has two ends respectively connected to the sliding push rod and the stop block. The headrest can extend and retract horizontally when users change their posture.

8 Claims, 7 Drawing Sheets

ADJUSTABLE CHAIR HEADREST

CROSS-REFERENCE TO RELATED APPLICATIONS

This application claims the benefit and priority of Chinese Patent Application Number 202220196296.9, filed on Jan. 21, 2022 with China National Intellectual Property Administration, the disclosures of which are incorporated herein by reference in their entireties.

BACKGROUND OF THE INVENTION

1. Technical Field

The invention belongs to the technical field of office chairs, and particularly relates to an adjustable chair headrest.

2. Description of Related Art

Most headrests on the present market are rotatable and liftable, but unmovable in the horizontal direction. Chair headrests that can be moved in the horizontal direction and locked at different positions are designed, but these chair headrests do not follow the head of users to support the head when the users change their sitting posture. If users have to adjust the front-back position of the headrest every time they change their sitting posture, inconvenience will be caused to the users, and the working efficiency of the users will be affected. So, the invention designs a headrest that can be elastically pushed forward to support the head of users when the users change the position of their head such as tilting their head forward slightly. Moreover, through the design of a tension spring at the top, users can use springs with different elasticity coefficients as the tension spring to obtain different support forces.

BRIEF SUMMARY OF THE INVENTION

In view of the defects of the prior art, the objective of the invention is to provide an adjustable chair headrest to solve the problems mentioned in the description of the related art.

The objective of the invention may be fulfilled through the following technical solution: an adjustable chair headrest comprises a support rod connected to a chair back, and a headrest, and further comprises an elastic sliding mechanism connecting the headrest and the support rod, wherein the elastic sliding mechanism is provided with a lock mechanism used for defining a fixed distance between the headrest and the support rod, and comprises a stop block disposed on a horizontal rod body at a top of the support rod, a sliding push rod slidably connected to the stop block, and a tension spring connecting the sliding push rod and the stop block to form an elastic telescoping mechanism by the sliding push rod and the stop block, and an end, away from the stop block, of the sliding push rod is connected to the headrest through a damping hinge;

The stop block is located above the sliding push rod, and is detachably connected to the support rod to be received in a groove formed in the horizontal rod body of the support rod, an end, away from the headrest, of the sliding push rod stretches into the groove of the support rod, a gap is reserved between the sliding push rod and an end, close to the headrest, of the stop block, the tension spring is disposed in the gap and has an end disposed around an end, close to the support rod, of the sliding push rod as well as an end disposed around the end, close to the headrest, of the stop block, and a cover is disposed on the stop block to cover the groove of the support rod.

Further, the lock mechanism comprises a stop bolt, a connecting hole is formed in the horizontal rod body at the top of the support rod, the stop bolt is slidably connected into the connecting hole, and multiple retaining holes for receiving the stop bolt are formed in the sliding push rod in an array in a sliding direction of the sliding push rod.

Further, a spring and a crank are disposed at a bottom of the stop bolt, a shaft shoulder is disposed on the stop bolt, a bottom of the stop bolt is fixedly connected to the crank, the crank is connected to the support rod in a threaded manner, and the spring is located between a bottom of the shaft shoulder of the stop bolt and the crank.

Further, a stop rod is disposed on a top surface of the sliding push rod, the stop rod and the sliding push rod are detachably connected or integrally formed, a sliding hole for receiving the stop rod is formed in a position, corresponding to the stop rod, of the stop block, and a length of the stop rod received in the sliding rod is less than an ultimate tensile length of the tension spring.

Further, a stop block is disposed on a side face, close to the headrest, of the cover, a retaining hole for receiving the stop block is formed in a side face, close to the headrest, of the horizontal rod body at the top of the support rod, a clamping block is disposed at an end, away from the stop block, of the cover, a slot for receiving the clamping block is horizontally formed in an end face, away from the headrest, of the support rod, and when the cover covers the support rod, the stop block is inserted into the retaining hole, and the clamping block is inserted into the slot.

Further, a sliding chute is formed in a vertical rod of the slot and is slidably connected to the chair back through a damping hinge.

Further, the sliding push rod is made of a metal material.

Further, the cover is made of a transparent material.

The invention has the following beneficial effects: the headrest can extend and retract horizontally, so that the head of users can still be supported by the headrest when the users change their sitting posture, and the headrest has a simple connecting structure, and is easy to manufacture and suitable for wide application.

BRIEF DESCRIPTION OF THE SEVERAL VIEWS OF THE DRAWINGS

To more clearly explain the technical solutions of the embodiments of the invention or the prior art, drawings used for describing the embodiments of the invention or the prior art will be briefly introduced below. Obviously, those ordinarily skilled in the art may obtain other drawings according to the following ones without creative labor.

Figure 1:
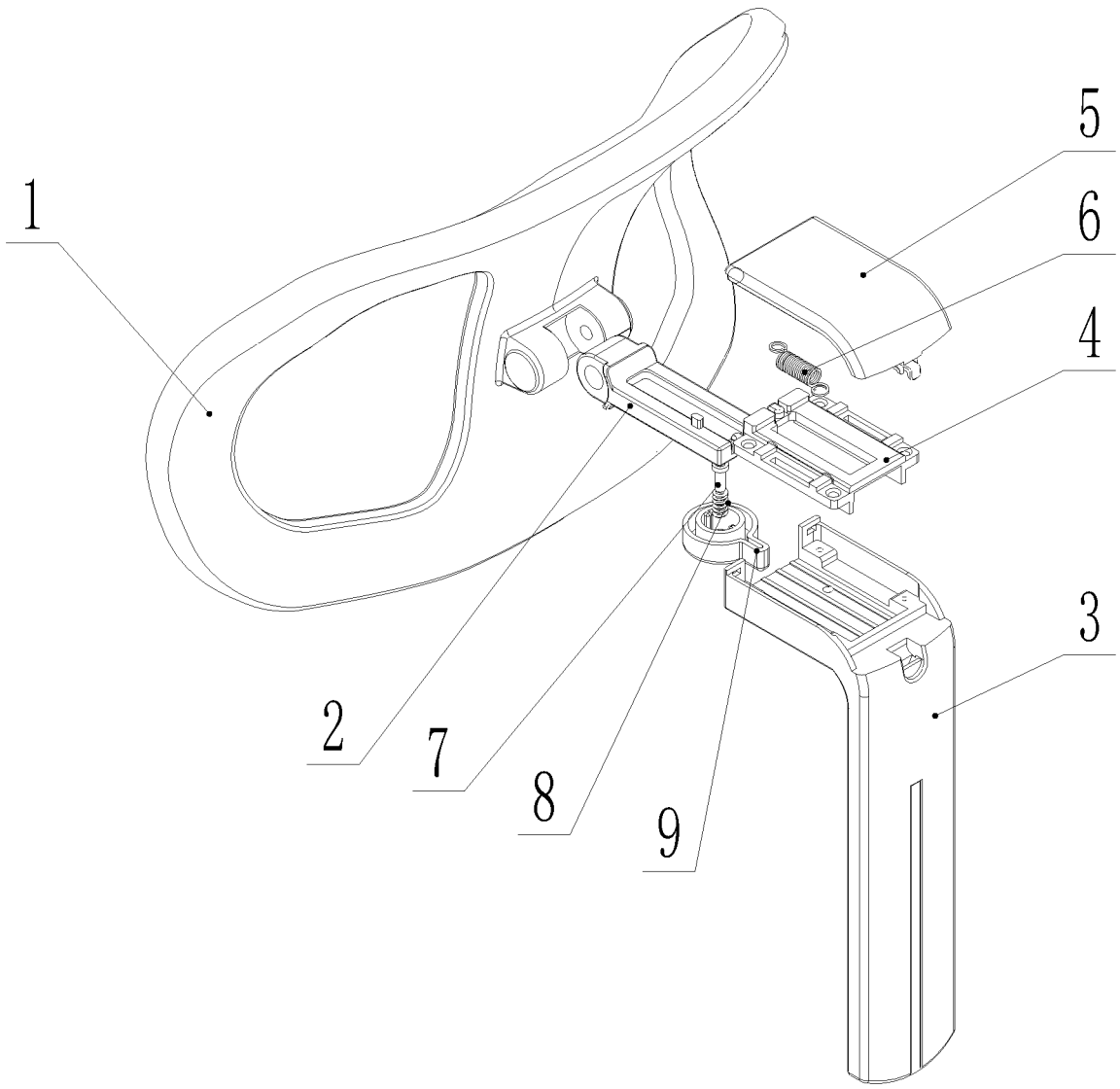
FIG. 1 is an overall structural view of the invention.

In the figures: 1, headrest; 2, sliding push rod; 3, support rod; 4, stop block; 5, cover; 6, tension spring; 7, stop bolt; 8, spring; 9, crank; 21, first connecting block; 22, stop rod;

23, retaining hole; 31, slot; 32, retaining hole; 33, sliding chute; 34, connecting hole; 41, second connecting block; 42, sliding hole; 43, connecting hole; 51, stop block; 52, clamping block.

DETAILED DESCRIPTION OF THE INVENTION

The technical solutions of the embodiments of the invention will be clearly and completely described below in conjunction with the accompanying drawings of the embodiments of the invention. Obviously, the embodiments in the following description are merely illustrative ones, and are not all possible ones of the invention. All other embodiments obtained by those ordinarily skilled in the art based on the following ones without creative labor should also fall within the protection scope of the invention.

Referring to FIG. 1-FIG. 7, one embodiment of the invention provides an adjustable chair headrest, comprising a support rod 3 connected to a chair back, and a headrest 1, and further comprising an elastic sliding mechanism connecting the headrest 1 and the support rod 3, wherein the elastic sliding mechanism is provided with a lock mechanism for defining a fixed distance between the headrest 1 and the support rod 3, and comprises a stop block 4 disposed on a horizontal rod body at a top of the support rod 3, a sliding push rod 2 slidably connected to the stop block 4, and a tension spring 6 for connecting the sliding push rod 2 and the stop block 4 to form an elastic telescoping mechanism by the sliding push rod 2 and the stop block 4, and an end, away from the stop block 4, of the sliding push rod 2 is connected to the headrest 1 through a damping hinge; and optionally, the sliding push rod 2 is made of a metal material such as aluminum, thus being easy to machine and light.

Figure 2:
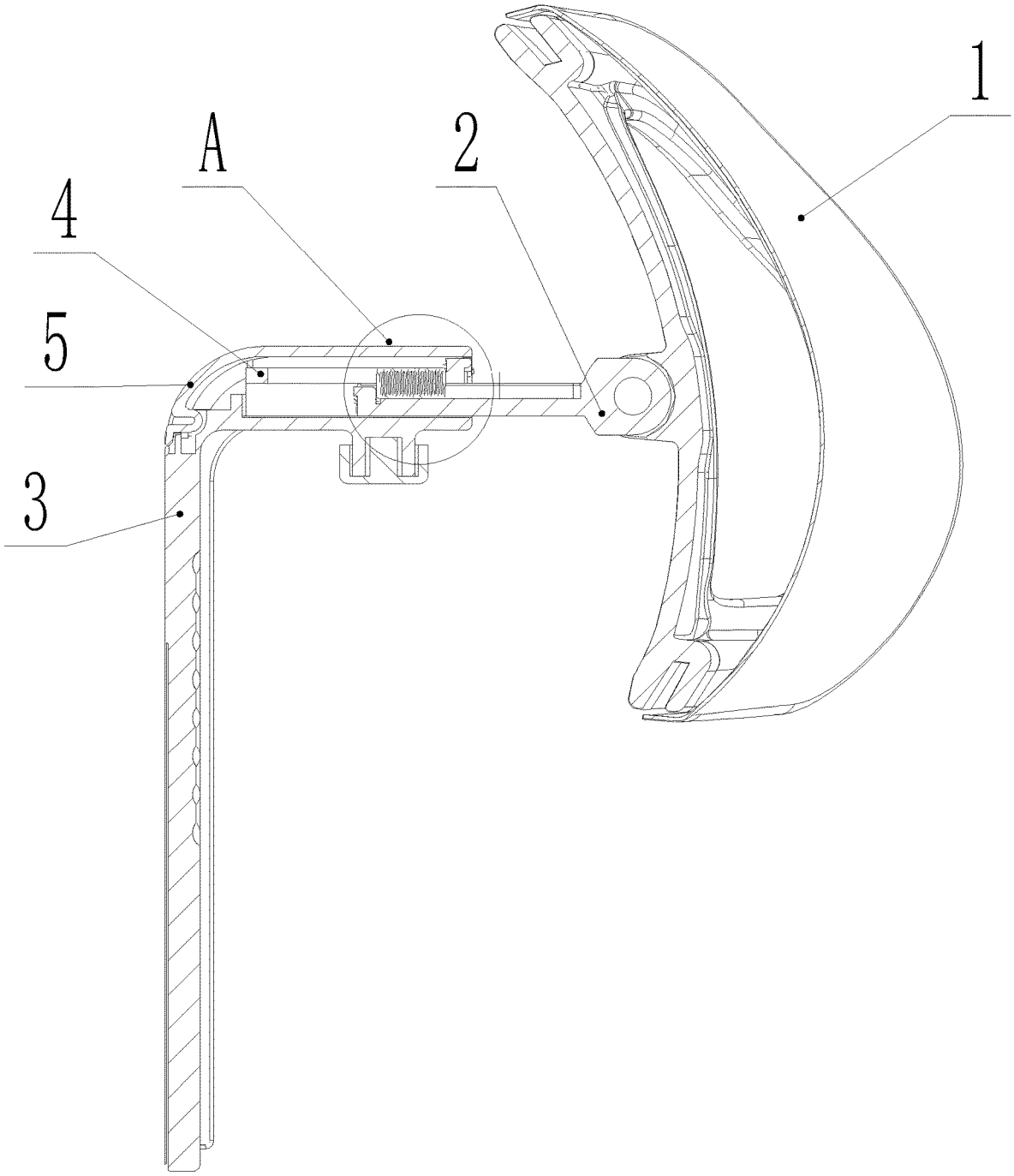
FIG. 2 is a sectional view of the invention.
Figure 3:
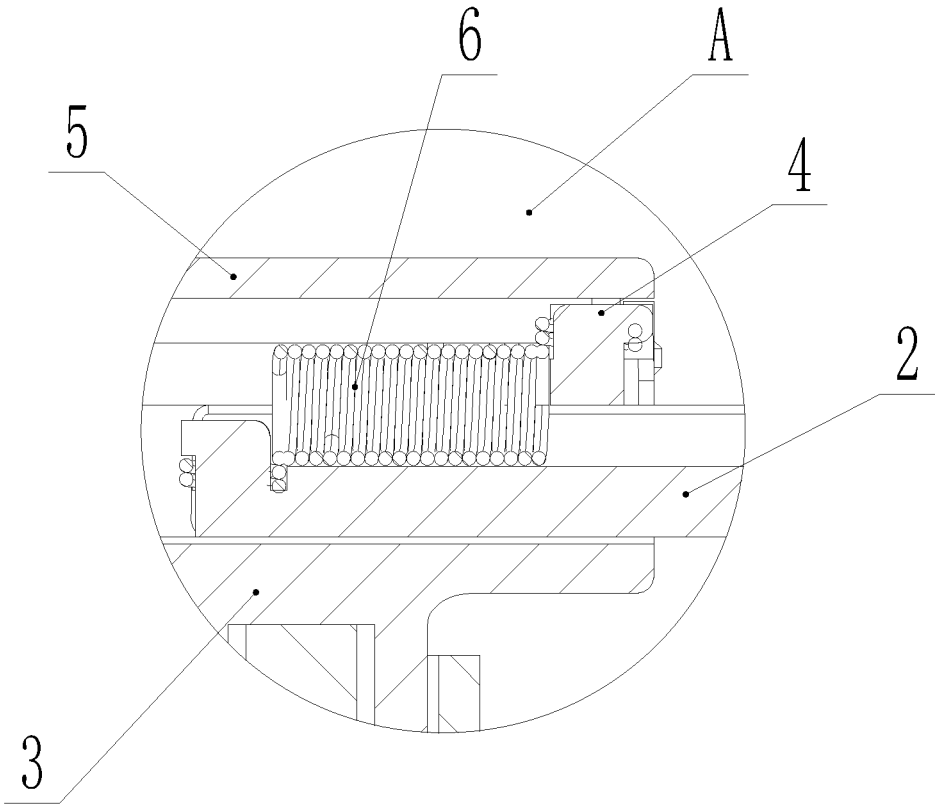
FIG. 3 is an enlarged view of part A in FIG. 2.
Figure 4:
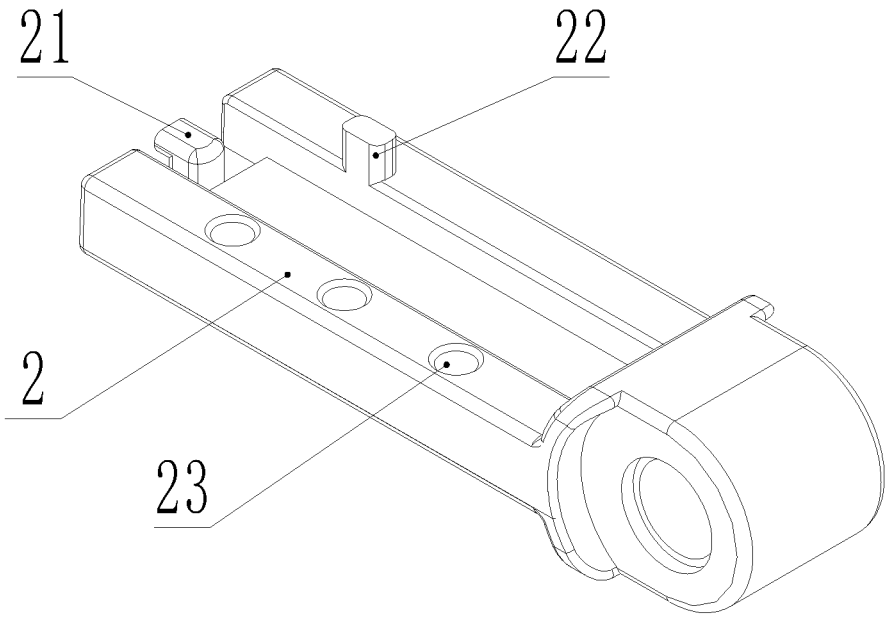
FIG. 4 is a structural view of a sliding push rod according to the invention.
Figure 5:
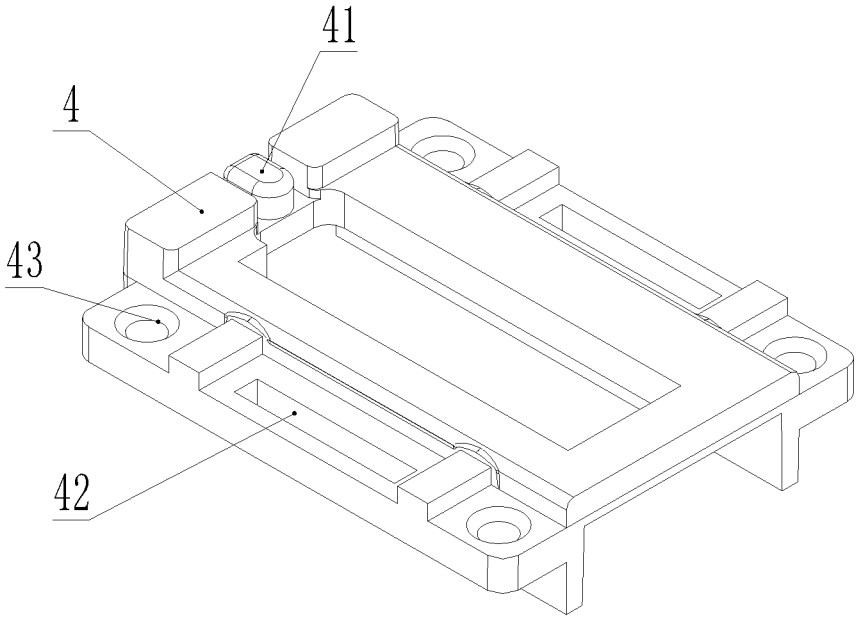
FIG. 5 is a structural view of a stop block according to the invention.

The stop block 4 is located above the sliding push rod 2, and is detachably connected to the support rod 3 to be received in a groove formed in the horizontal rod body of the support rod 3; specifically, the stop block 4 may be fixedly connected to the support rod 3 with bolts, and connecting holes 43 for mounting bolts are formed in the periphery of the stop block 4; an end, away from the headrest 1, of the sliding push rod 2 stretches into the groove of the support rod 3; a gap is reserved between the end, away from the headrest 1, of the sliding push rod 2 and the end, close to the headrest 1, of the stop block 4, and the tension spring 6 is disposed in the gap; one end of the tension spring 6 is disposed around an end, close to the support rod 3, of the sliding push rod 2, and the other end of the tension spring 6 is disposed around an end, close to the headrest 1, of the stop block 4; a cover 5 is disposed on the stop block 4 to cover the groove of the support rod 3, and the stop block 4 is detachably connected to the support rod 3; as shown in FIG. 3 to FIG. 5, a first connecting block 21 is disposed at the end, close to the support rod 3, of the sliding push rod 2, a second connecting block 41 is disposed at the end, close to the headrest 1, of the stop block 4, the first connecting block 21 and the second connecting block 41 are both of an inverted-L shape, and the two ends of the tension spring 6 are provided with retaining rings which are disposed around the first connecting block 21 and the second connecting block 41 respectively, so the tension spring is unlikely to fall; as shown in FIG. 2, when the headrest 1 is stressed, the sliding push rod 2 is pushed to move leftwards, and at this moment, the tension spring 6 is stretched; when released, the headrest 1 moves rightwards to restore under the elastic force of the tension spring 6; in this way, the headrest 1 is elastically supported in the horizontal direction and can be adjusted according to the sitting posture of users to always support the head of the users, thus improving the comfort of users and meeting market requirements.

Figure 6:
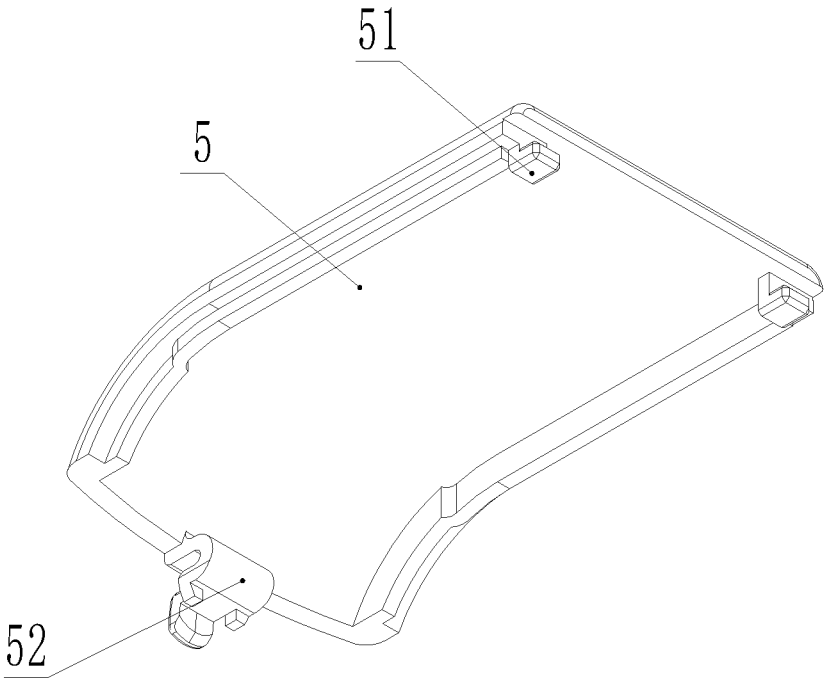
FIG. 6 is a structural view of a tension spring according to the invention.
Figure 7:
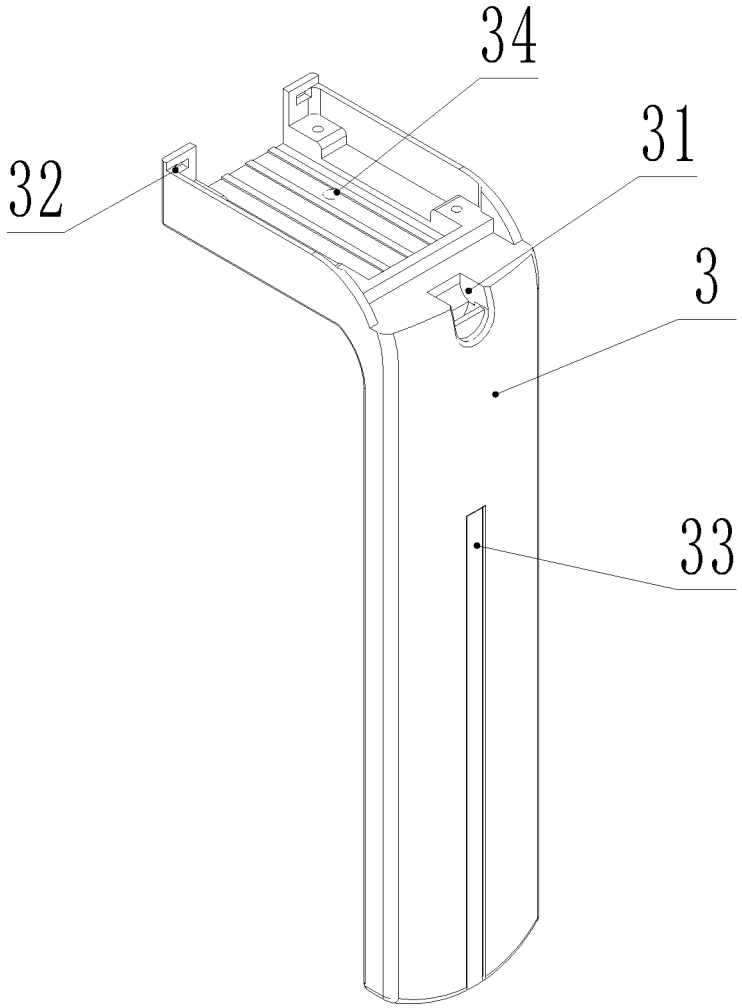
FIG. 7 is a structural view of a support rod according to the invention.

Specifically, as shown in FIG. 6 and FIG. 7, a stop block 51 is disposed on a side face, close to the headrest 1, of the cover 5, a retaining hole 32 for receiving the stop block 51 is formed in a side face, close to the headrest 1, of the horizontal rod body at the top of the support rod 3, a clamping block 52 is disposed at an end, away from the stop block 51, of the cover 5, and a slot 31 for receiving the clamping block 52 is horizontally formed in an end face, away from the headrest 1, of the support rod 3; and when the cover 5 covers the support rod 3, the stop block 51 is inserted into the retaining hole 32, the clamping block 52 is inserted into the slot 31, and the tension spring 6 may be replaced with a tension spring of a different model provide different support forces. Optionally, the cover 5 is made of a transparent material, so that the model of the tension spring 6 inside and the state of components can be observed.

Further, as shown in FIG. 1, the lock mechanism comprises a stop bolt 7, a connecting hole 34 is formed in the horizontal rod body at the top of the support rod 3, the stop bolt 7 is slidably connected into the connecting hole 34, and multiple retaining holes 23 for receiving the stop bolt 7 are formed in the sliding push rod 2 in an array in a sliding direction of the sliding push rod 2. When fixing the distance between the headrest 1 and the support rod 3, users insert the stop bolt 7 into one corresponding retaining hole 23 in the sliding push rod 2, and then the sliding push rod 2 is fixed and limited through the stop bolt 7, the corresponding retaining hole 23 and the connecting hole 34.

Optionally, a spring 8 and a crank 9 are disposed at a bottom of the stop bolt 7, a shaft shoulder is disposed on the stop bolt 7, the bottom of the stop bolt 7 is fixedly connected to the crank 9, the crank 9 is connected to the support rod 3 in a threaded manner, and the spring 8 is located between a bottom of the shaft shoulder of the stop bolt 9 and the crank 9 and is used for restoration. Users can control the stop bolt 7 to slide upwards or downwards by rotating the crank 9, so that operation is convenient and fast.

Optionally, as shown in FIG. 4 and FIG. 5, a stop rod 22 is disposed on a top surface of the sliding push rod 2, the stop rod 22 and the sliding push rod 2 are detachably connected or integrally formed, a sliding hole 42 for receiving the stop rod 22 is formed in a position, corresponding to the stop rod 22, of the stop block 4, and the length of the stop rod 22 received in the sliding hole 42 is less than an ultimate tensile length of the tension spring 6. When installed, the sliding push rod 2 is installed on the support rod 3 first, then the stop block 4 is installed to insert the stop rod 22 into the sliding hole 42, that is, the stop rod 22 is stopped moving by the sliding hole 42, so the sliding push rod 2 is effectively prevented from being separated from the support rod 3, and the spring 8 is prevented from being stretched out of the ultimate tensile length.

Optionally, a sliding chute 33 is formed in a vertical rod of the slot 31, and is slidably connected to the chair back through a damping hinge, that is, users can adjust the height of the headrest 1 according to their height.

It should be understood that, in the description of the invention, terms such as "upper", "lower", "left" and "right" are used to indicate directional or positional relationships based on the accompanying drawings, merely for the purpose of facilitating and simplifying the description of the invention, do no indicate or imply that a device or element referred to must be in a specific direction or be configured or operated in a specific direction, thus should not be construed as limiting the invention.

In addition, terms "first" and "second" are merely for the purpose of description, and should not be construed as indicating or implying relative importance or implicitly indicating the number of technical features referred to. In the description of the invention, "a plurality of" means two or more, unless otherwise expressly stated.

Those skilled in the art may make various changes, modifications, substitutions and transformations to the above embodiments without departing from the principle and spirit of the invention. Thus, from any point of view, these embodiments should be regarded as instructional and nonrestrictive, and the scope of the invention is defined by the appended claims rather than the above description. The above embodiments are merely preferred ones of the invention, and are not used to limit the invention. All modifications, equivalent substitutions and improvements made based on the spirit and principle of the invention should fall within the protection scope of the invention.

What is claimed is:

1. An adjustable chair headrest, comprising a support rod (3) connected to a chair back, and a headrest (1), wherein the adjustable chair headrest further comprises an elastic sliding mechanism connecting the headrest (1) and the support rod (3), the elastic sliding mechanism is provided with a lock mechanism used for defining a fixed distance between the headrest (1) and the support rod (3), and comprises a stop block (4) disposed on a horizontal rod body at a top of the support rod (3), a sliding push rod (2) slidably connected to the stop block (4), and a tension spring (6) connecting the sliding push rod (2) and the stop block (4) to form an elastic telescoping mechanism by the sliding push rod (2) and the stop block (4), and an end, away from the stop block (4), of the sliding push rod (2) is connected to the headrest (1) through a damping hinge;

the stop block (4) is located above the sliding push rod (2), and is detachably connected to the support rod (3) to be received in a groove formed in the horizontal rod body of the support rod (3), an end, away from the headrest (1), of the sliding push rod (2) stretches into the groove of the support rod (3), a gap is reserved between the sliding push rod (2) and an end, close to the headrest (1), of the stop block (4), the tension spring (6) is disposed in the gap and has an end disposed around an end, close to the support rod (3), of the sliding push rod (2) as well as an end disposed around the end, close to the headrest (1), of the stop block (3), and a cover (5) is disposed on the stop block (4) to cover the groove of the support rod (3).

2. The adjustable chair headrest according to claim 1, wherein the lock mechanism comprises a stop bolt (7), a connecting hole (34) is formed in the horizontal rod body at the top of the support rod (3), the stop bolt (7) is slidably connected into the connecting hole (34), and multiple retaining holes (23) for receiving the stop bolt (7) are formed in the sliding push rod (2) in an array in a sliding direction of the sliding push rod (2).

3. The adjustable chair headrest according to claim 2, wherein a spring (8) and a crank (9) are disposed at a bottom of the stop bolt (7), a shaft shoulder is disposed on the stop bolt (7), a bottom of the stop bolt (7) is fixedly connected to the crank (9), the crank (9) is connected to the support rod (3) in a threaded manner, and the spring (8) is located between a bottom of the shaft shoulder of the stop bolt (7) and the crank (9).

4. The adjustable chair headrest according to claim 1, wherein a stop rod (22) is disposed on a top surface of the sliding push rod (2), the stop rod (22) and the sliding push rod (2) are detachably connected or integrally formed, a sliding hole (42) for receiving the stop rod (22) is formed in a position, corresponding to the stop rod (22), of the stop block (4), and a length of the stop rod (22) received in the sliding rod (42) is less than an ultimate tensile length of the tension spring (6).

5. The adjustable chair headrest according to claim 1, wherein a stop block (51) is disposed on a side face, close to the headrest (1), of the cover (5), a retaining hole (32) for receiving the stop block (51) is formed in a side face, close to the headrest (1), of the horizontal rod body at the top of the support rod (3), a clamping block (52) is disposed at an end, away from the stop block (51), of the cover (5), a slot (31) for receiving the clamping block (52) is horizontally formed in an end face, away from the headrest (1), of the support rod (3), and when the cover (5) covers the support rod (3), the stop block (51) is inserted into the retaining hole (32), and the clamping block (52) is inserted into the slot (31).

6. The adjustable chair headrest according to claim 5, wherein a sliding chute (33) is formed in a vertical rod of the slot (31) and is slidably connected to the chair back through a damping hinge.

7. The adjustable chair headrest according to claim 1, wherein the sliding push rod (2) is made of a metal material.

8. The adjustable chair headrest according to claim 1, wherein the cover (5) is made of a transparent material.

* * * * *